US007498062B2

(12) United States Patent
Calcaterra et al.

(10) Patent No.: US 7,498,062 B2
(45) Date of Patent: Mar. 3, 2009

(54) METHOD AND APPARATUS FOR APPLYING A VOLTAGE TO A SUBSTRATE DURING PLATING

(75) Inventors: Anthony Calcaterra, Milpitas, CA (US); David Knox, La Mirada, CA (US)

(73) Assignee: WD Media, Inc., San Jose, CA (US)

( * ) Notice: Subject to any disclaimer, the term of this patent is extended or adjusted under 35 U.S.C. 154(b) by 897 days.

(21) Appl. No.: 10/853,953

(22) Filed: May 26, 2004

(65) Prior Publication Data

US 2005/0274605 A1 Dec. 15, 2005

(51) Int. Cl.
*B05D 1/18* (2006.01)
*C25D 5/00* (2006.01)
*C25D 7/00* (2006.01)

(52) U.S. Cl. ..... 427/430.1; 427/437; 427/443.1; 205/137; 205/143; 205/145

(58) Field of Classification Search ..... 205/137, 205/143, 145; 427/430.1, 437, 443.1
See application file for complete search history.

(56) References Cited

U.S. PATENT DOCUMENTS

| | | | | |
|---|---|---|---|---|
| 1,453,419 | A | 5/1923 | Thompson et al. | 204/199 |
| 1,475,937 | A | 12/1923 | Daniels | 428/675 |
| 2,211,295 | A | 8/1940 | Searles et al. | 308/184 |
| 2,244,197 | A | 6/1941 | Hessler | 308/216 |
| 2,979,452 | A | 4/1961 | Ludwig et al. | 204/212 |
| 3,304,138 | A | 2/1967 | Sampatacos | 308/195 |
| 3,640,592 | A | 2/1972 | Howe, Jr. | 308/193 |
| 3,880,480 | A | 4/1975 | Anderson | 308/74 |
| 4,105,310 | A * | 8/1978 | Hirata et al. | 352/171 |
| 4,324,441 | A | 4/1982 | Ronverol et al. | 308/177 |
| 4,344,657 | A | 8/1982 | Borel | 308/6 C |
| 4,516,523 | A | 5/1985 | Knox | 118/500 |
| 4,581,260 | A | 4/1986 | Mawla | 427/443.1 |
| 5,174,045 | A | 12/1992 | Thompson et al. | 34/58 |
| 5,264,256 | A | 11/1993 | Wozniak, Jr. et al. | 427/535 |
| 5,358,460 | A * | 10/1994 | Vranish | 475/344 |
| 5,716,147 | A | 2/1998 | Cook et al. | 384/492 |
| 5,750,207 | A | 5/1998 | Hammond et al. | 427/576 |
| D411,176 | S | 6/1999 | Shimazu | D13/182 |
| 5,951,763 | A * | 9/1999 | Knox | 118/409 |
| 5,997,947 | A | 12/1999 | Burns et al. | 427/240 |
| 6,056,123 | A | 5/2000 | Niemirowski et al. | 206/711 |
| 6,065,615 | A | 5/2000 | Uchiyama et al. | 211/41.18 |
| 6,089,377 | A | 7/2000 | Shimizu | 206/711 |
| 6,099,302 | A | 8/2000 | Hong et al. | 432/259 |

(Continued)

OTHER PUBLICATIONS

"Enplate ADP-300(QA) Electroless Nickel Process for General Plating Applications", copyright 2000, Enthone-OMI, Inc., Connecticut, no month.

*Primary Examiner*—Edna Wong
(74) *Attorney, Agent, or Firm*—Stuart B. Chinn, Esq.; Kenneth Leeds, Esq.

(57) ABSTRACT

A method for applying a strike voltage to one or more substrates during plating. During this method, the substrates are moved in a planetary manner while being held at their exterior edges by a set of parallel mandrels. (The substrates are held in a mutually parallel orientation, typically vertically, during plating.) A voltage is applied to the substrates via a contact pin, a contact plate, a set of ball bearings, a rack end-plate, and the mandrels.

8 Claims, 11 Drawing Sheets

U.S. PATENT DOCUMENTS 6,216,709 B1 4/2001 Fung et al.
6,341,935 B1 1/2002 Tseng ..... 41/800
6,370,791 B1 4/2002 Weaver et al. ..... 34/58
6,372,303 B1 4/2002 Burger et al. ..... 427/569
6,528,124 B1 3/2003 Nguyen
6,550,972 B1 4/2003 Adolph et al. ..... 384/448
6,558,750 B2 5/2003 Gramarossa et al. ..... 427/430.1
6,568,412 B2 5/2003 Egashira ..... 134/159
6,617,540 B2 9/2003 Zehavi ..... 219/121.64
6,660,104 B2 12/2003 Thompson et al. ..... 134/33
6,663,762 B2 12/2003 Bleck et al. ..... 205/123
6,664,122 B1 12/2003 Andryuschenko et al. ..... 438/17
6,673,216 B2 1/2004 Pedersen et al. ..... 204/212
6,709,563 B2 3/2004 Nagai et al. ..... 205/123

* cited by examiner

METHOD AND APPARATUS FOR APPLYING A VOLTAGE TO A SUBSTRATE DURING PLATING

BACKGROUND OF THE INVENTION

This invention pertains to methods for applying a voltage to a substrate during plating. This invention also pertains to apparatus for applying a voltage to a substrate during plating.

During various industrial processes one plates a material onto a substrate. For example, U.S. Provisional Patent Application No. 60/535,380 filed by Bajorek et al. discusses a process whereby one plates NiP onto a disk-shaped metallic substrate during the course of making a master or a stamper used during CD and DVD manufacturing. (The '380 provisional application is incorporated herein by reference.) Plating is performed during numerous other industrial processes, e.g. magnetic disk manufacturing.

During some plating processes, plating is "electroless", i.e. a voltage is not applied to the substrate being plated. We have found that initiation of electroless plating can be enhanced by applying a "strike voltage" to the substrates. It would be desirable to provide plating apparatus that facilitates application of such a voltage.

SUMMARY OF THE INVENTION

Apparatus for plating material onto one or more substrates comprises a set of elongated arms (e.g. mandrels) for holding the outer edge of the substrates. In one embodiment, the substrates are electrically conductive, and can be disk-shaped. The arms are connected to a connecting member, which in turn is coupled to a source of electrical power. (Typically, the connecting member is provided on one end of the arms, and a second connecting member is connected to the other end of the arms.) The structure comprising the arms, connecting member and substrates are placed into a plating bath. Rotational motion and electrical power are imparted to the connecting member during at least a portion of the plating process. (The substrates are typically rotated during the entire plating process, but electrical power is typically only imparted to the substrates during a portion of the process.)

In one embodiment, the substrates are moved in a planetary manner, e.g. using a gear system that imparts planetary motion. At least one of the gears comprises an electrically conductive region that is electrically coupled to the connecting member. The electrically conductive region can be a plate affixed to a surface of the gear. An electrical path (e.g. comprising a wire) extends from a power source outside the plating bath (e.g. a voltage source) into the bath to a contact member that is in sliding contact with the conductive region to thereby apply electrical power to the substrates.

In one embodiment, one can remove the structure from the bath comprising the connecting member, arms and substrates. At least one of the arms can be removed so that plated substrates can be removed from the apparatus, and new substrates can be loaded back into the apparatus. The removable arm can be re-attached to the connecting member, and then the connecting member, arms and substrates can be placed back within the bath so that the new substrates can be plated.

DETAILED DESCRIPTION

Figure 1A:
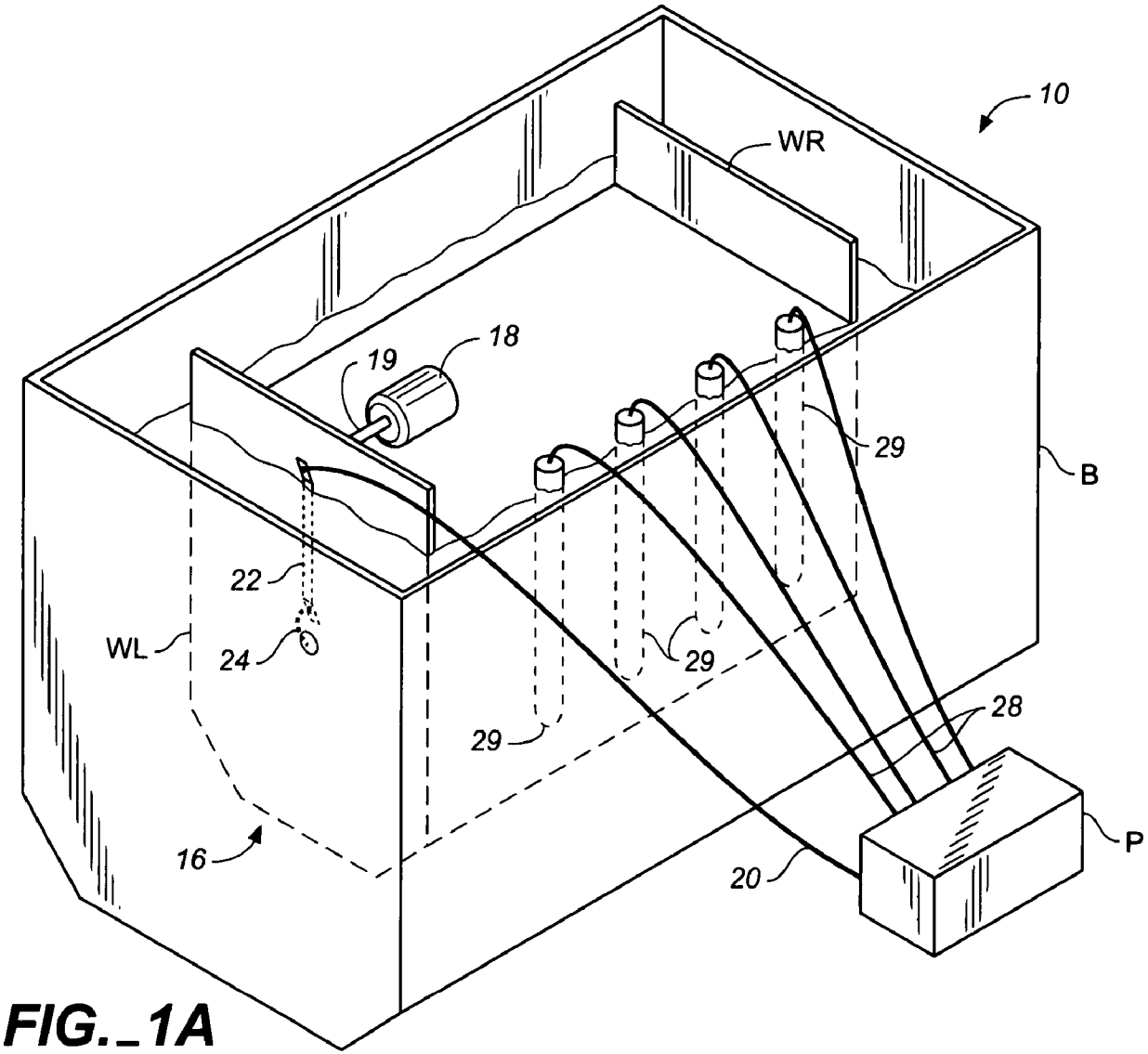
FIG. 1A illustrates plating apparatus constructed in accordance with the invention.
Figure 1B:
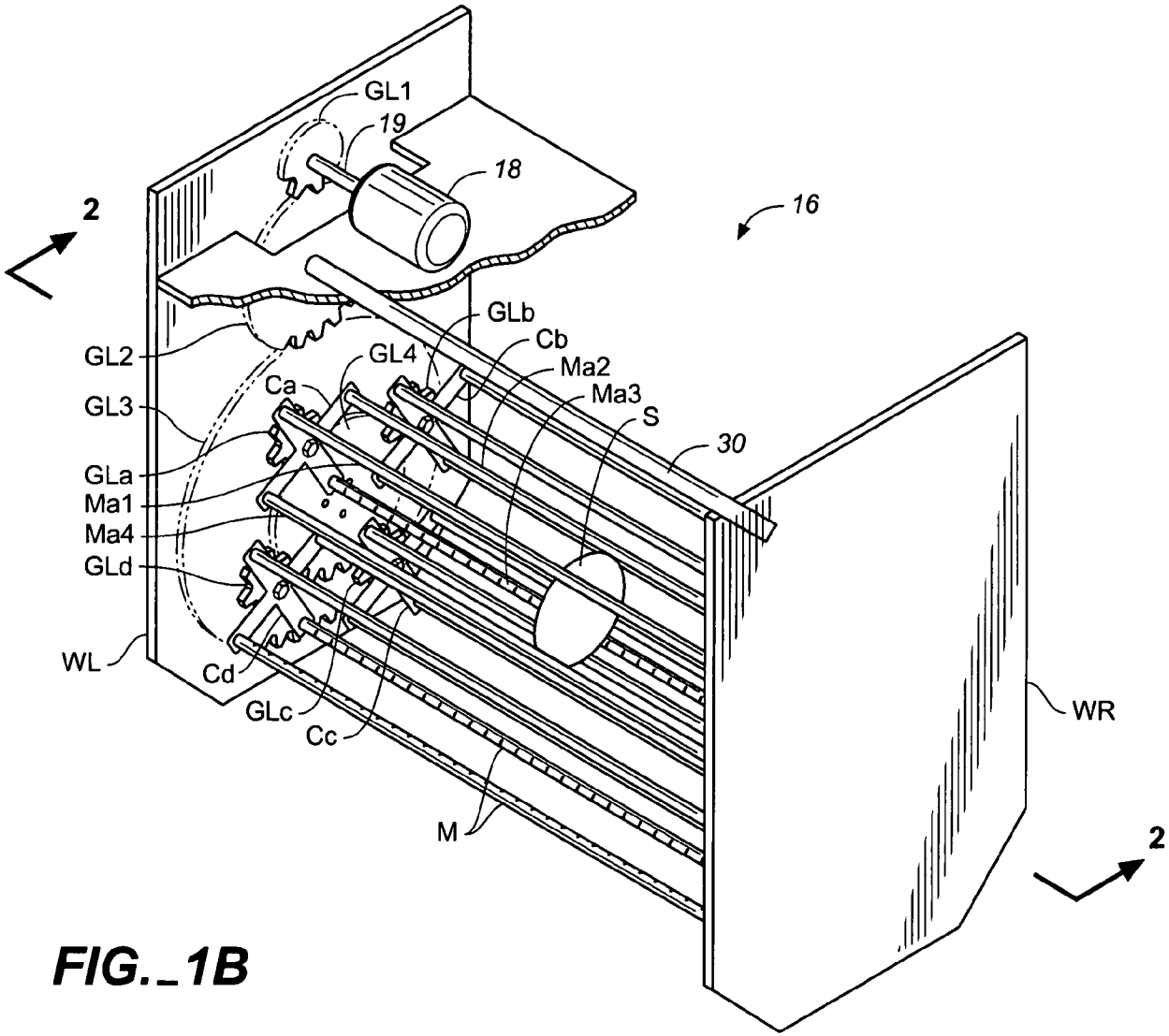
FIG. 1B illustrates a structure for holding substrates to be plated within the apparatus of FIG. 1A. (Details concerning the structure of FIG. 1B are not shown in FIG. 1A for ease of illustration.)
Figure 2:
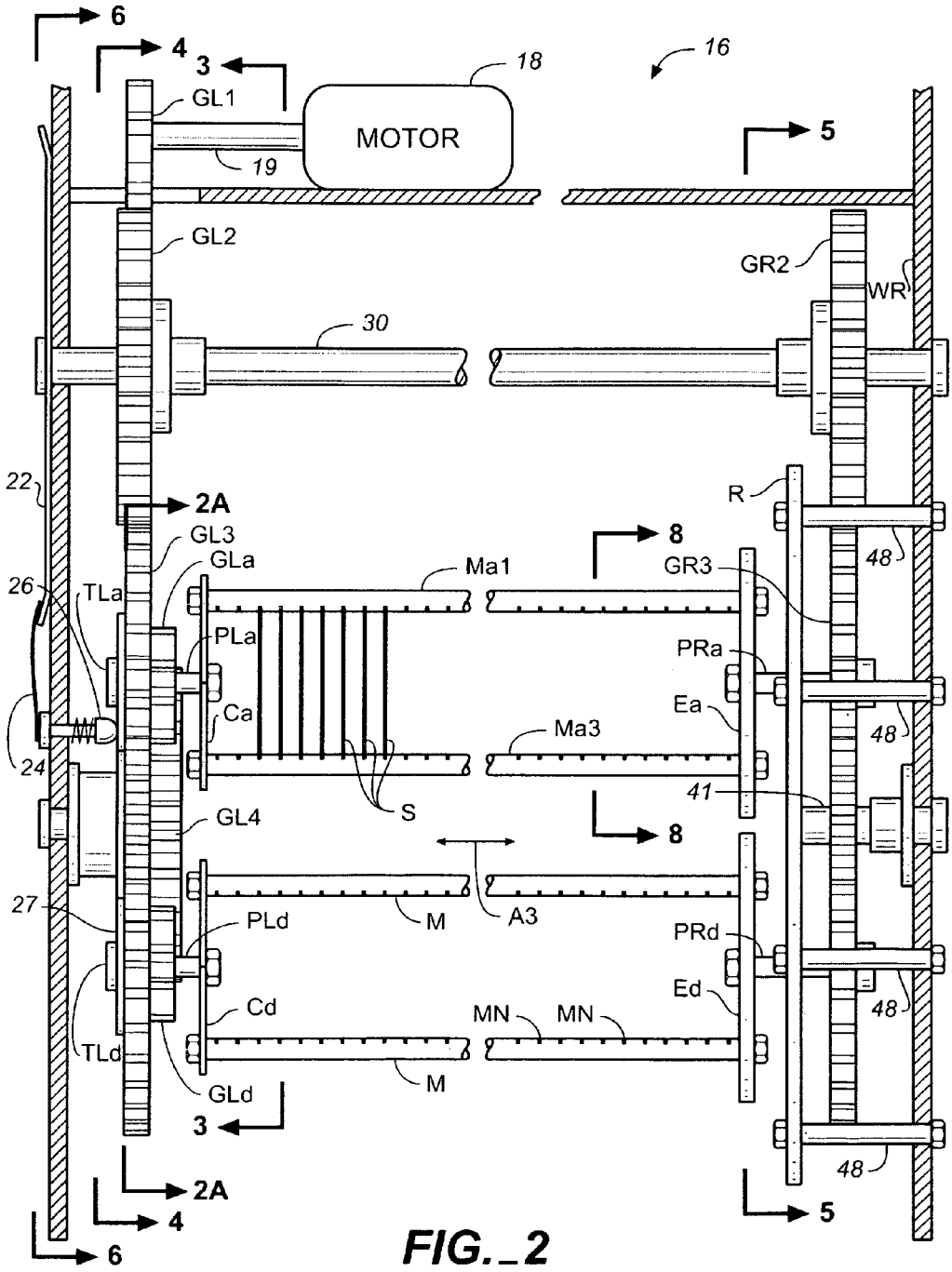
FIG. 2 is a front cross section view of the structure of FIG. 1B.
Figure 2A:
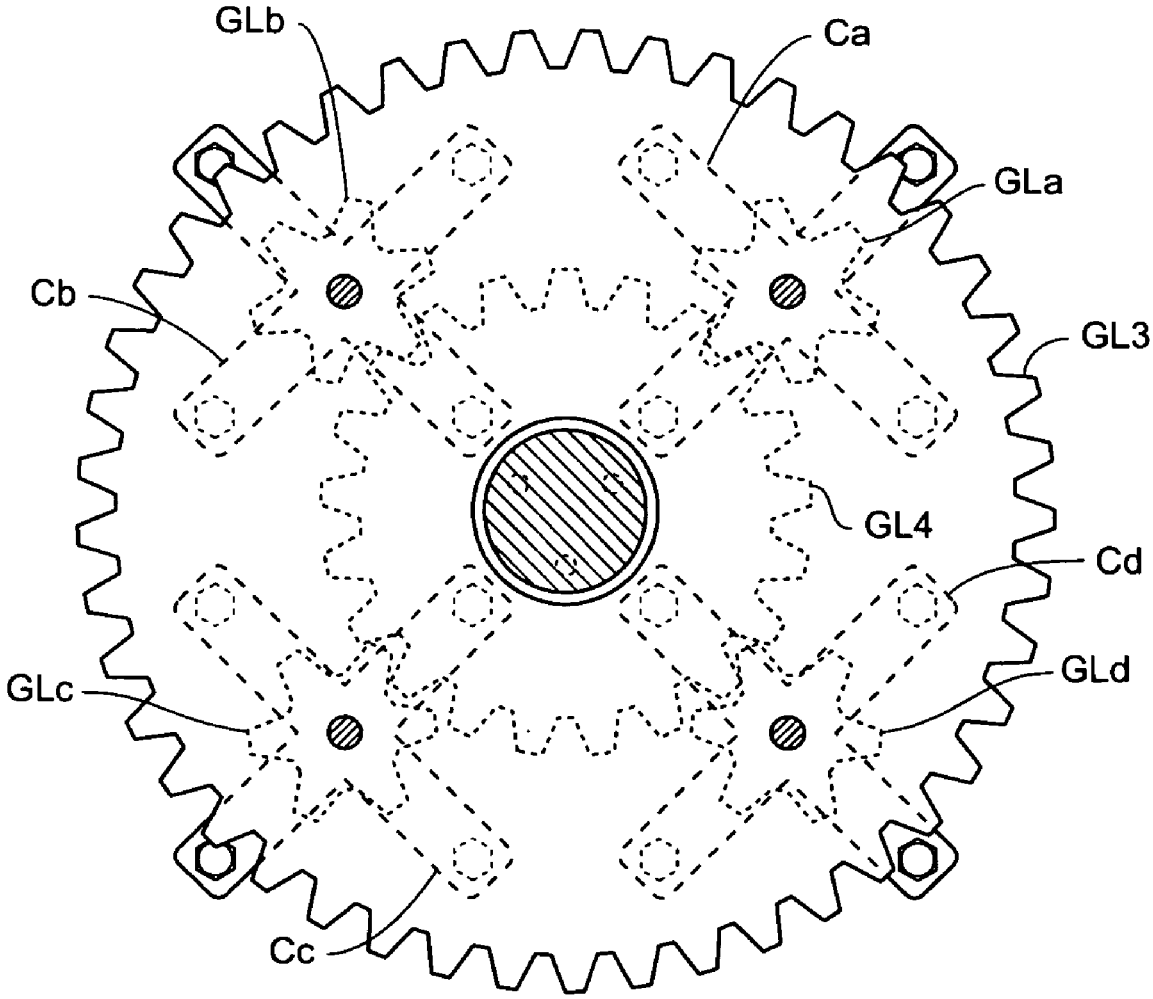
FIG. 2A illustrates in cross section the structure of FIG. 2 taken along lines 2A-2A.
Figure 8:
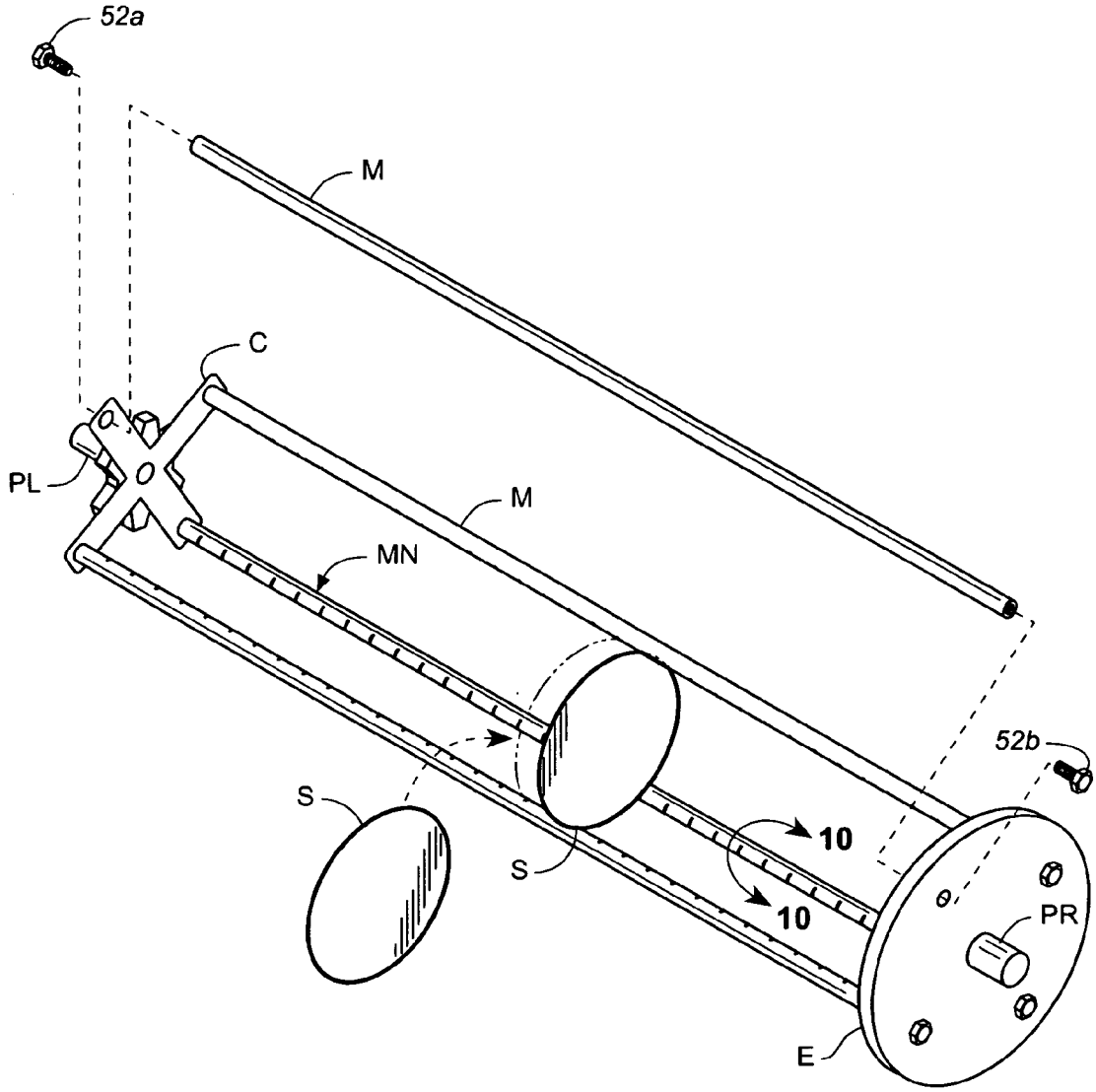
FIG. 8 illustrates a portion of the structure of FIGS. 1B and 2 comprising a set of mandrels for holding substrates, an end plate connected to one end of the mandrels, and a cruciform connected to the other end of the mandrels.
Figure 9:
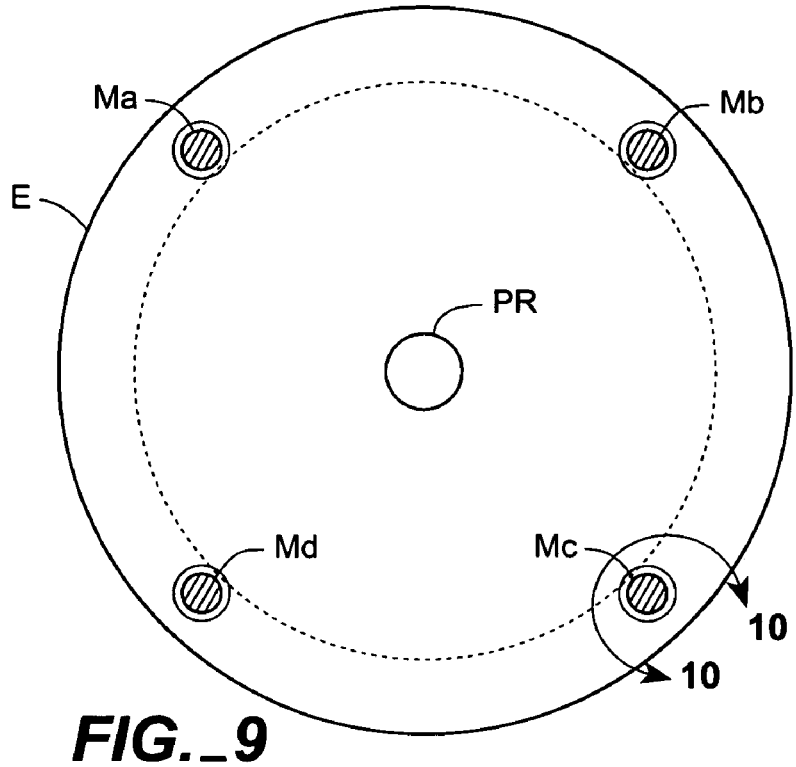
FIG. 9 illustrates in plan view an end plate for connecting to the mandrels.

FIGS. 1A and 1B illustrate apparatus 10 for plating a layer of material onto substrates S (FIGS. 1B, 2 and 8). Substrates S can be disk-shaped metal substrates (e.g. an aluminum or copper alloy), and the material plated onto the substrate can be a nickel-phosphorus alloy. However, these materials are merely exemplary. In one embodiment, substrates S have a centrally defined opening therein (not shown), but in other embodiments, substrates S do not have such a centrally defined opening.

Apparatus 10 includes a bath B containing plating solution and a holder 16 immersed in bath B for holding and moving substrates S. (Only one substrate S is shown in FIG. 1B, but typically numerous substrates are simultaneously held by holder 16. The internal structure of holder 16 is not shown in FIG. 1A for ease of illustration, but is shown in FIG. 1B.)

As explained below, during plating substrates S are held by a set of mandrels M. (Mandrels M are substantially parallel. Also, substrates S are substantially parallel.) Apparatus 10 comprises a motor 18 which turns a system of gears GL1-GL3 and GLa-GLd for moving mandrels M (and hence substrates S) in a planetary manner during plating. Gears GL1-GL3 and GLa-GLd drive mandrels M from the left side of apparatus 10. Gears GR2 and GR3 (similar to gears GL2 and GL3 and shown in FIGS. 2 and 5) drive mandrels M from the right side of apparatus 10. The mechanical coupling between motor 18 and mandrels M is described below. In one embodiment the motion of substrates S through the plating solution facilitates a) more even plating of material onto the substrate surfaces, b) a more homogenous thickness and surface roughness, and c) greater plating solution velocity across substrates S to remove bubbles and particles to theoretically reduce the number of defects.

Another feature of apparatus 10 is that it applies a voltage to substrates S during at least a portion of the plating process via a source of electrical power P, cable 20, bar 22 (mounted on the outside of left wall WL of holder 16), wire 24 (FIGS. 2 and 6), spring-loaded contact pin 26, metal contact plate 27 (mounted on gear GL3, and shown in FIGS. 2, 4 and 6), a set of trunions TLa-TLd, cruciforms Ca-Cd and mandrels M. In this way, a "strike voltage" can be applied to substrates S at the start of plating. (The electrical return path is provided via cables 28 and bars 29 (immersed in bath B, shown in FIG. 1).) The strike voltage electrical path is discussed below, following the discussion of the mechanism for driving (moving) the mandrels.

Mechanism for Moving Mandrels M and Substrates S During Plating

Figure 5:
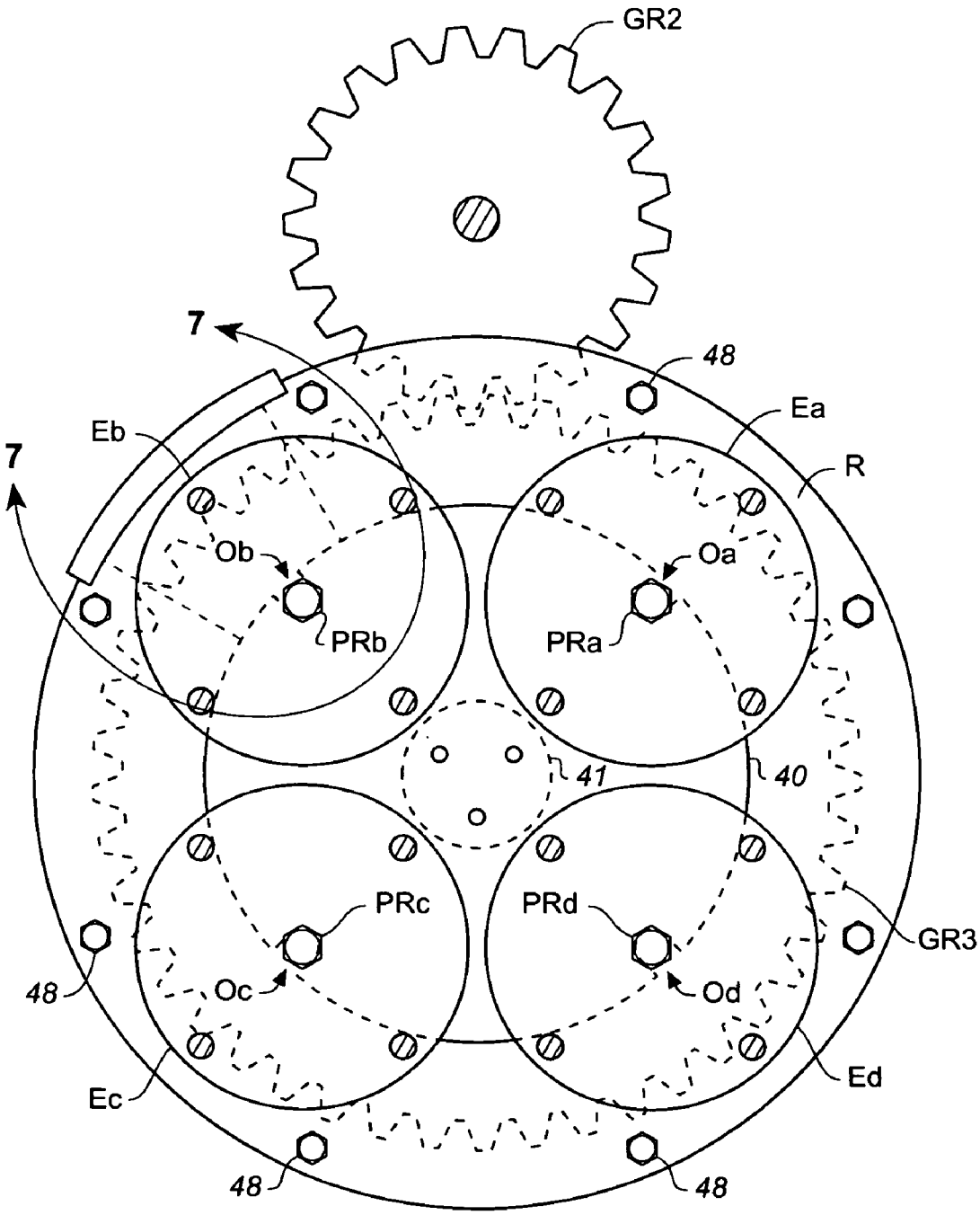
FIG. 5 illustrates in cross section the structure of FIG. 2 taken along lines 5-5.

Holder 16 comprises four sets of mandrels M, each set comprising four mandrels for holding a set of substrates S. For example, in FIG. 1B, one set of mandrels (comprising mandrels Ma1, Ma2, Ma3 and Ma4) is shown holding a substrate S. Referring to FIGS. 1B and 2, the left end of each set of mandrels is connected to an associated one of cruciforms Ca-Cd and on the right end of each set of mandrels is connected to an associated one of end plates Ea-Ed. (Only two end plates Ea and Ec, two cruciforms Ca and Cc, and four mandrels M are shown in FIG. 2 because it is a cross section drawing. However, all four end plates Ea-Ed are shown in FIG. 5.)

Each cruciform Ca-Cd is rigidly connected associated posts PLa-PLd, which in turn are rigidly connected to associated gears GLa-GLd. Posts PLa-PLd are also rotatably coupled to gear GL3 via trunions TRa-TRd. Each end plate Ea-Ed is rotatably coupled via an associated one of posts PRa-PRd to gear GR3. As explained below, gears GLa-GLd, GL3 and GR3 are parts of a gear mechanism that moves mandrels M in a planetary manner during plating. The motion of gear GL3 is synchronized with gear GR3 to cause mandrels M to revolve about the central axis A3 (FIG. 2) of gear GL3 (which is also the central axis of gear GR3). Gear GL3 drives mandrels M from the left side of holder 16, while gear GR3 drives mandrels M from the right side of holder 16. A description of the mechanism that drives mandrels M from the left side will be provided, followed by a description of the mechanism that drives mandrels M from the right side.

Figure 3:
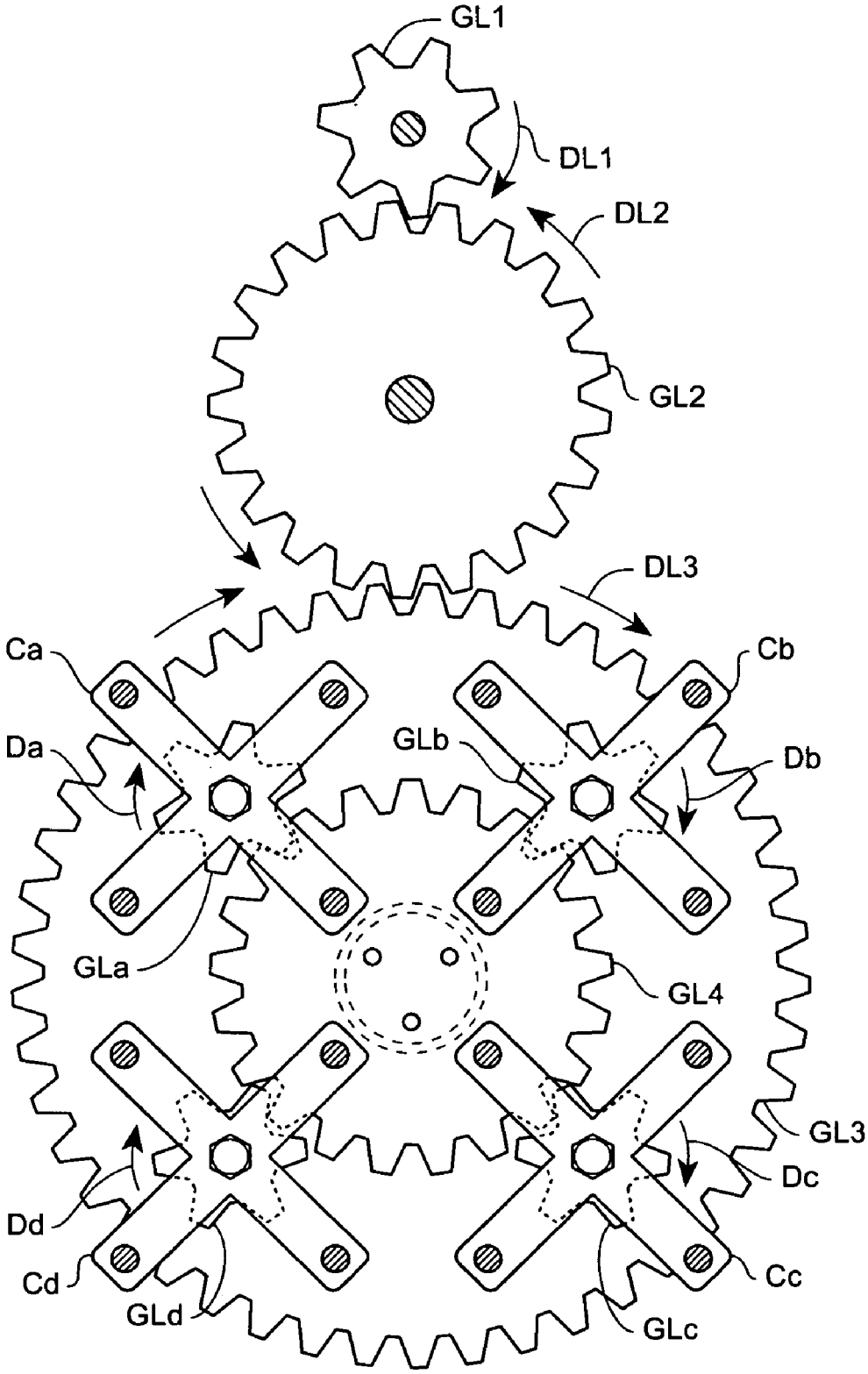
FIG. 3 illustrates in cross section the structure of FIG. 2 taken along lines 3-3 comprising a set of gears for imparting planetary motion to substrates during plating.

A motor 18 drives a rotor shaft 19 which in turn drives first gear GL1 in a direction DL1 (FIG. 3), which in turn drives second gear GL2, in a direction DL2 which in turn drives third gear GL3 in a direction DL3. Trunions TLa-TLd are affixed to and extend through associated openings in gear GL3. Each one of posts PLa-PLd is rotatably mounted within an associated one of trunions TLa-TLd. Thus, as gear GL3 rotates about its central axis A3, posts PLa-PLd also rotate about axis A3. Since posts PLa-PLd are rigidly connected to cruciforms Ca-Cd, respectively, cruciforms Ca-Cd and mandrels M also rotate about axis A3.

A gear GL4 is rigidly (non-rotatably) mounted to wall WR of holder 16. Gears GLa-GLd are each rigidly (non-rotatably) connected to an associated one of posts PLa-PLd. As post PLa rotates about the central axis A3 of gear GL3, gear GLa engages gear GL4, thereby causing gear GLa rotate in a direction Da, which in turn causes post PLa, cruciform Ca and the associated set of mandrels Ma1-Ma4 to rotate about the central axis of gear GLa. Thus, not only do mandrels Ma1-Ma4 rotate about central axis A3 of gear GL3, but they also rotate about the central axis of gear GLa. Gears GLb-GLd similarly engage with gear GL3, thereby causing posts PLb-d, cruciforms Cb-d, and their associated mandrels M to rotate about the central axis of associated gears GLb-GLd in directions Db-Dd, respectively.

Referring back to FIGS. 1B and 2, gear GL2 also drives an idler shaft 30, which in turn drives gear GR2, which in turn drives gear GR3. Gear GR3 is rigidly affixed to a rotating plate 40 (FIGS. 5 and 7) via a post 41. Posts PRa-PRd, extending from associated end plates Ea-Ed, ride in openings Oa-Od of plate 40. Thus, as gear GR3 rotates about axis A3, plate 40 and end plates E also rotate about axis A3. Gears GL3 and GR3 move synchronously, and therefore, both sides of mandrels M are driven synchronously.

Posts PRa-PRd rotate freely within openings Oa-Od. There is nothing analogous to gears GLa-GLd on the right side of holder 16. Thus, in the illustrated embodiment, rotation of mandrels M about the axes of gears GLa-GLd is imparted only from the left side of holder 16 and not from the right side of holder 16. However, in alternative embodiments, such rotation of mandrels M about the axis of gears GLa-GLd can be imparted from both the left and right sides of holder 16. Alternatively, in other embodiments, such motion could be imparted from only the right side of holder 16. Referring to FIG. 5, a ring R extends about plate 40. Ring R is fixedly mounted to a side wall WR of holder 16 via posts 48, and does not rotate. Thus, plate 40 rotates within ring R. Ring R prevents posts PRa-PRd from disengaging from openings Oa-Od in plate 40 during use.

Application of Electrical Power to Substrates S

Figure 4:
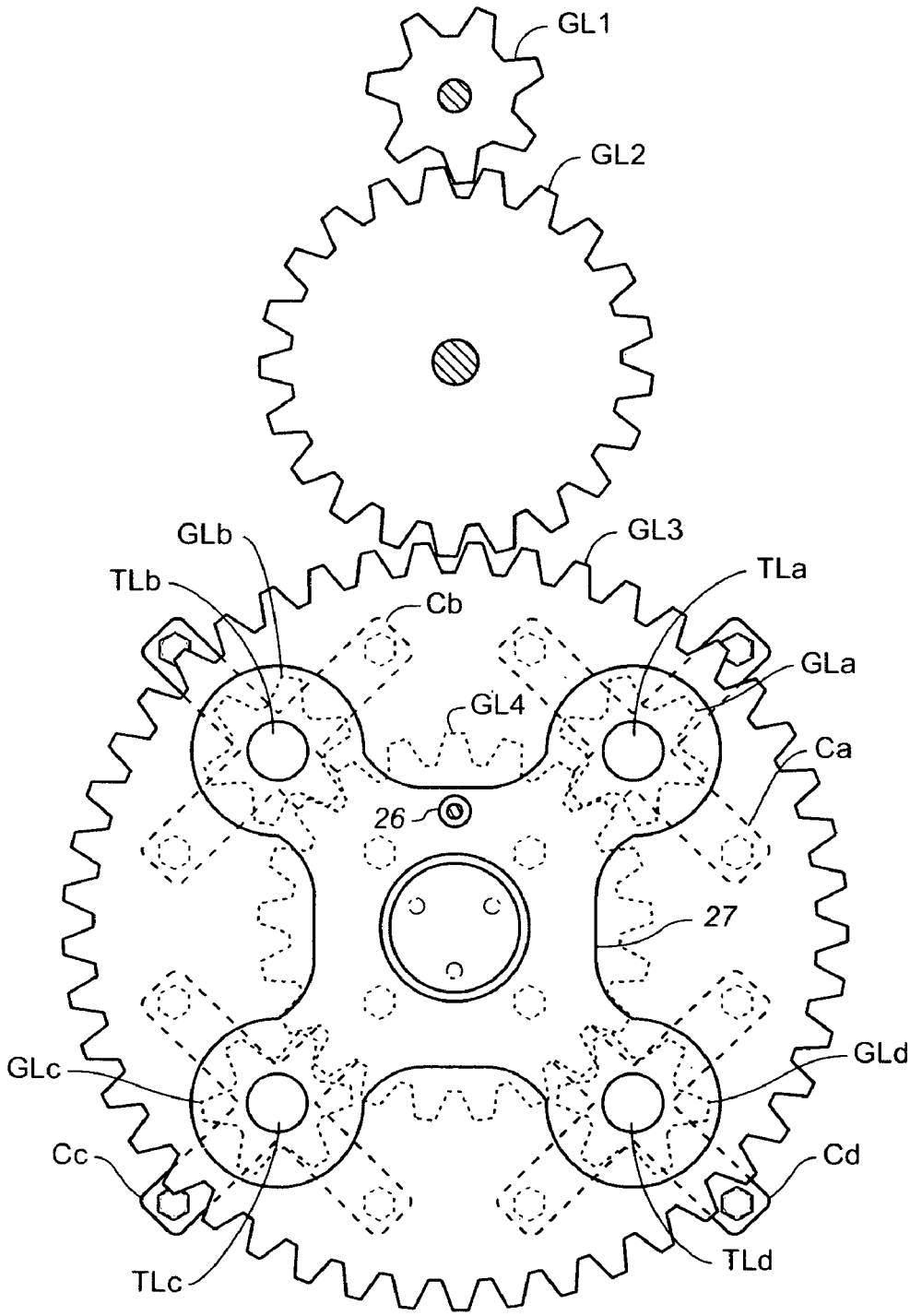
FIG. 4 illustrates in cross section the structure of FIG. 2 taken along lines 4-4 comprising the set of gears for imparting planetary motion to substrates during plating.
Figure 6:
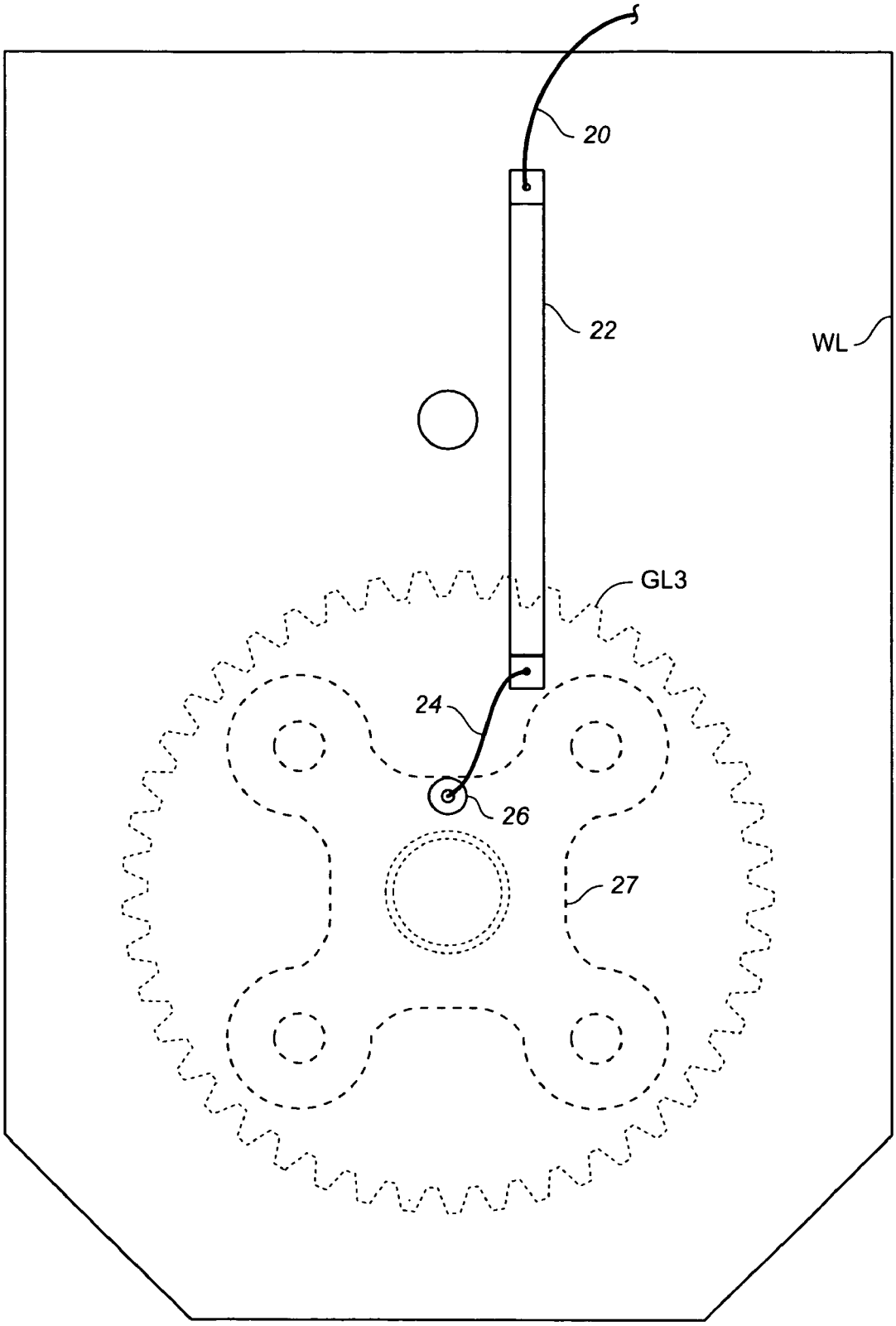
FIG. 6 illustrates in cross section the structure of FIG. 2 taken along lines 6-6.

As mentioned above, at the start of plating, a strike voltage is provided by electrical power source P, cable 20, bar 22, wire 24, spring-loaded contact pin 26, and metal contact plate 27 (mounted on gear GL3, and shown in FIGS. 4 and 6). Metal contact plate 27 is electrically coupled to mandrels M via trunions TRa-d, posts PLa-d, and cruciforms Ca-d. (Trunions TRa-d, posts PLa-d and cruciforms Ca-d are electrically conductive and typically made of metal.)

Figure 10:
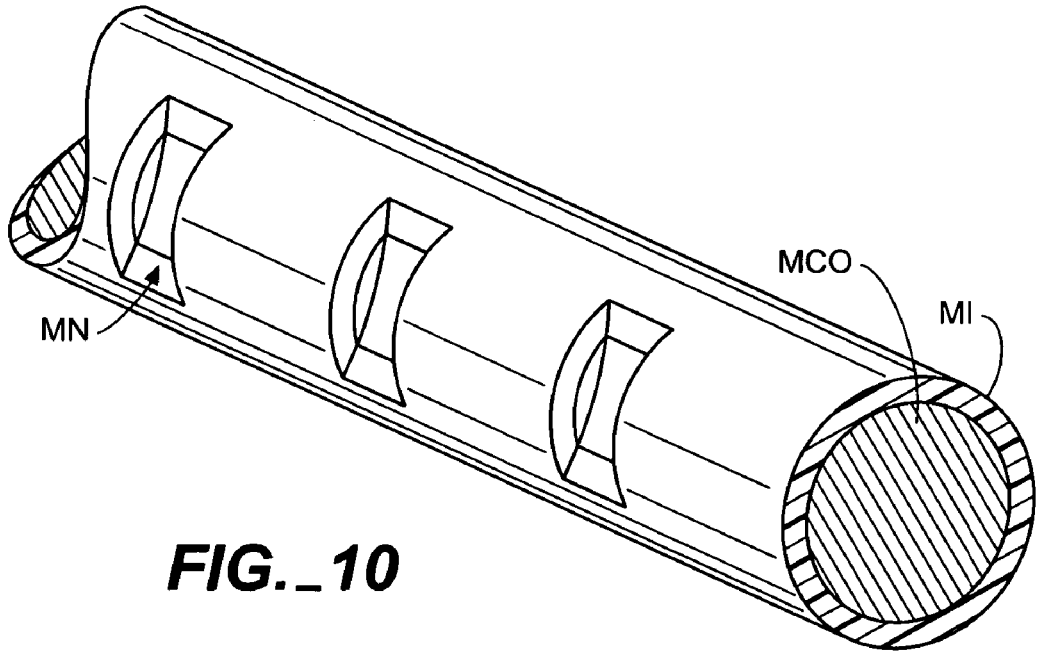
FIG. 10 illustrates a mandrel used in the apparatus of the above-mentioned figures for holding substrates during plating.

Mandrels M typically comprise an electrically conductive stainless steel core MCO (FIG. 10) surrounded by an electrically insulating polyvinyl difluoride coating MI. As each set of mandrels M is affixed to an associated one of metal cruciforms Ca-d, the conductive core MCO of each mandrel M electrically contacts one of cruciforms Ca-d. As seen in FIGS. 8 and 10, each mandrel M comprises a set of notches MN for holding substrates S. Notches MN expose conductive core MCO, so that each substrate S electrically contacts core MCO of the mandrels M holding that substrate. In this way, there is an electrical path from power source P to substrates S.

Apparatus 10 applies electrical power to substrates S only via the left side of mandrels M. Thus, end plates E are typically not electrically conductive. (The various gears in apparatus 10 are also not typically electrically conductive.) However, in other embodiments of the invention, electrical power can be applied to the right side, or both the right and left side, of mandrels M.

One advantage of using cruciforms Ca-Cd in lieu of conductive plates is the minimization of metallic surface area exposed to the plating solution. Similarly, the shape of electrically conductive plate 27 is also designed to minimize the metallic surface area exposed to the plating solution. Similarly, insulting coating MI also minimizes the metallic surface area exposed to the plating solution.

Loading and Unloading Substrates from Apparatus 10

Figure 7:
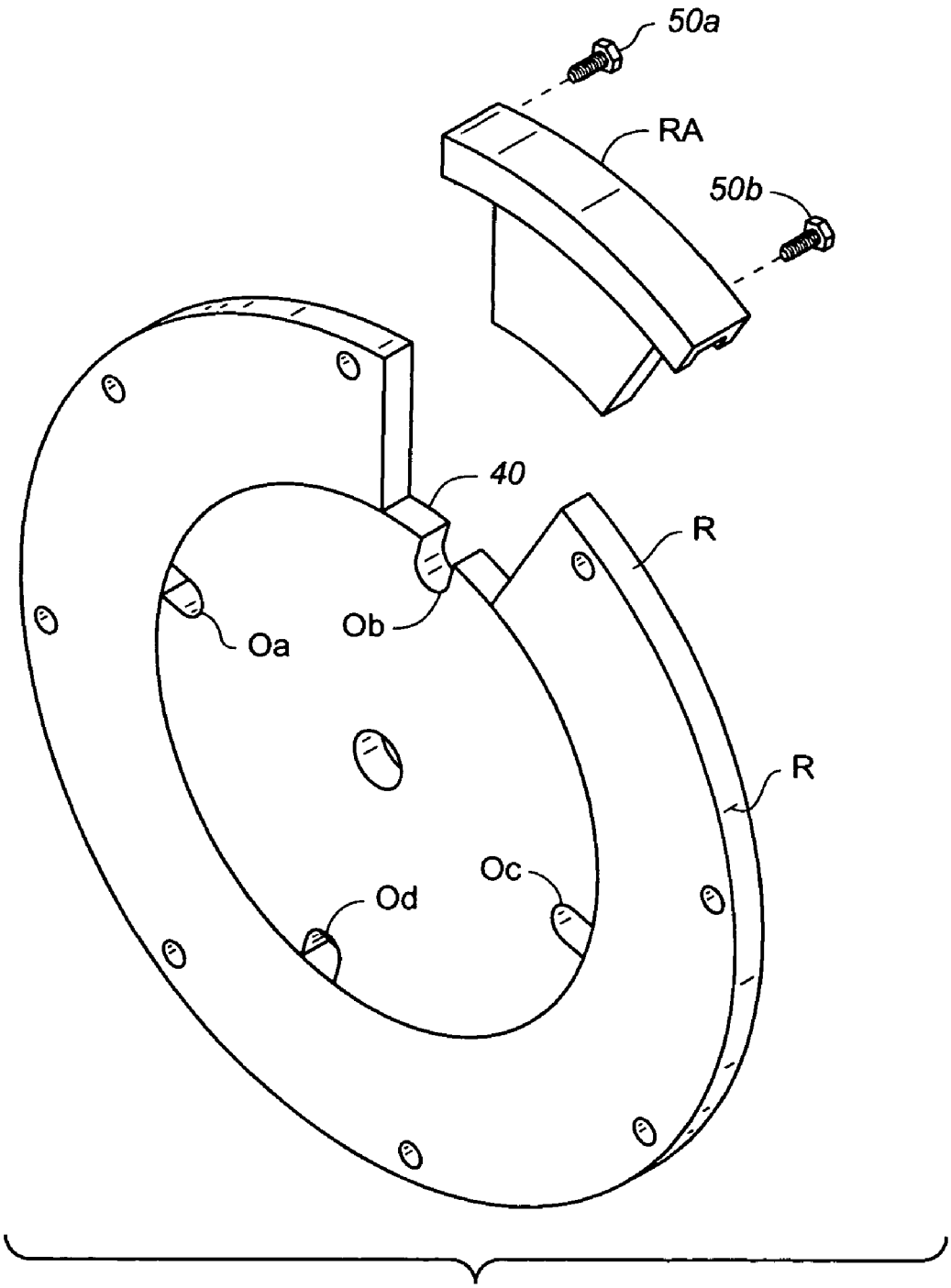
FIG. 7 illustrates the portion of the structure of FIG. 5 indicated by lines 7-7.

After plating, one removes holder 16 from bath B. One set of four mandrels M, associated endplate F and cruciform C form a "rack" for holding substrates (see FIG. 8). In one embodiment, each rack typically holds 42 substrates S. Holder 16 is designed so that the racks can be removed therefrom. In particular, an arcuate section RA of ring R is removed from ring R by removing screws 50*a*, 50*b* (FIG. 7).

One removes a rack of substrates from holder 16 by a) rotating the mandrels until one of posts PL is aligned with removed arcuate section RA. One then lifts the rack (including mandrels M, endplate E and cruciform C) out of holder 16. One then removes one of the mandrels M as shown in FIG. 8 by removing screws 52*a*, 52*b* which hold that mandrel in place. Once that mandrel is removed, substrates S can be loaded and/or unloaded from the rack. The mandrel is then replaced, and the rack can then be reinserted into the apparatus.

As mentioned above, apparatus of the present invention can be used for a variety of plating processes, including electroless plating and electroplating. In one process, one first soaks substrates S in an alkaline cleaner (e.g. a KOH solution plus an inhibitor), rinses substrates S, soaks substrates S in an acidic solution (e.g. phosphoric acid), again rinses the substrates, and then places the substrates in a first plating bath. This bath comprises the chemicals used to plate NiP, e.g. nickel sulfates, sodium hypophosphite and chelating agents. In one embodiment, the nickel plating chemistry can be type 300 ADP, manufactured by Enthone Corp. (See, for example, the data sheet entitled "ENPLATE ADP-300(QA) Electroless Nickel Process for General Plating Applications" published in 2000 by Enthone-OMI, Inc., incorporated herein by reference, submitted in an Information Disclosure Statement concurrently herewith.) Other plating chemistries are available from OMG Chemistries. A strike voltage of about 3 volts can be applied to the substrates, e.g. for about 15 to 60 seconds, but these parameters are merely exemplary. Thereafter, the substrates can be electrolessly plated in the same bath or a different bath from that used to apply the strike voltage.

While the invention has been described with respect to specific embodiments, those skilled in the art will recognize that changes can be made in form and detail without departing from the spirit and scope of the invention. For example, in lieu of using stainless steel to conduct electrical current to the substrates, other electrically conductive materials can be used. The disclosed apparatus can be used to plate materials other than NiP onto one or more substrates, and the substrates can comprise a material other than Al alloys or spinodal copper. The apparatus can be used to apply a strike voltage to initiate electroless plating. Alternatively, the apparatus can be used to apply a voltage during electroplating. Instead of using one electrical contact pin 26, multiple pins could be used. Alternatively, a brush, strip or ribbon contact could be used.

In lieu of using contact pin 26, in another embodiment, gear GL3 is mounted on and rotates about an electrically conductive bearing coupled by an electrically conductive post and bolt to wall WL of holding structure 16. In such an embodiment, wire 24 is connected to the portion of that bolt on the right side of wall WR. The conductive bearing is electrically connected to plate 27.

Some of the gears in the drawings have been illustrated as having different thicknesses. In alternative embodiments of the invention, the various gears have the same thickness.

In lieu of using cylindrical mandrels M, other types of holding members can be used to hold substrates S. For example, the mandrels can have the shape of arcuate sections of a cylinder. (As used herein, the term mandrel is not limited to a cylindrical mandrel. The term "arms" includes mandrels.) Different numbers of mandrels (other than four) can be used in each rack of substrates, and holder 16 can be designed to accommodate different numbers of racks (other than four). It is not necessary that all of mandrels M be electrically conductive. Also, it is not necessary that the entirety of cruciforms C be electrically conductive. Instead of using bar 22 and wire 24 to connect to pin 26, cable 20 can be connected directly to pin 26. Instead of placing all of bars 29 on one side of bath B, bars 29 can be arranged at different locations within bath B. Further, in lieu of bars 29, one could use a panel, grid, or any other shape of conductive material near the substrates. In another embodiment, gear GL3 is replaced with a wheel, and a pulley can connect rotor 19 to the wheel to rotate the mandrels. Instead of using the above-mentioned chemicals to plate NiP, other chemicals can be used. Further, the apparatus can be used to provide a plated layer of materials other than NiP.

A method and apparatus in accordance with the invention can be used to make masters or stampers, e.g. as discussed in the above-incorporated '380 application. Alternatively, one can use the method and apparatus to plate other types of substrates, e.g. to make magnetic disks or structures on semiconductor wafers.

Some embodiments of the invention employ one or more aspects and advantages of the above-described apparatus and method without employing other aspects and advantages. Accordingly, all such modifications come within the present invention.

We claim:

1. A method for plating one or more substrates comprising:

holding an outer edge of one or more substrates within a plating bath with a plurality of elongated arms, at least one of said arms being coupled to a source of electrical power and communicating said electrical power to said one or more substrates, said plurality of elongated arms being coupled to a connecting member;

rotating said connecting member, whereby said elongated arms and said substrates rotate about the axis of rotation of said connecting member; and plating said one or more substrates.

2. Method of claim 1 further comprising applying electrical power to said one or more substrates during a first portion of a plating process but not a second portion of said plating process.

3. Method of claim 1 wherein said connecting member is rotatably coupled to a second rotating member so that said connecting member can rotate about an axis of rotation of said connecting member while simultaneously rotating about the axis of rotation of said second rotating member to thereby impart planetary motion to said connecting member, said arms and said one or more substrates.

4. Method of claim 3 wherein said second rotating member is a first rotating gear, said first rotating gear being driven by a motor, said connecting member being coupled to a second rotating gear, a non-rotating gear engaging said second rotating gear, thereby causing said second rotating gear to rotate about an axis of rotation of said second gear and thereby causing said arms and said one or more substrates to rotate about said axis of rotation of said second rotating gear.

5. Method of claim 4 wherein said connecting member is in the shape of a cruciform, at least a portion of said cruciform and said elongated arms being electrically conductive, at least a portion of said elongated arms being covered with insulating material.

6. Method of claim 4 wherein said first rotating gear comprises an electrically conductive surface region, said method further comprising:

providing an electrically conductive path extending from outside said plating bath to a location within said plating bath, said path including a conductive member dragging across said conductive surface as said first rotating gear rotates; and providing a conductive bearing having a first bearing side mechanically coupled to said first gear and electrically coupled to said conductive surface region and a second bearing side rotatably coupled to said first bearing side, said second bearing side being coupled to said connecting member, whereby said electrical power can be transmitted from outside said bath, through said conductive path, said conductive member, said conductive surface region, said connecting member and said elongated arm to said one or more substrates.

7. Method of claim 4 wherein a third gear is coupled to a rotor of said motor, said third gear driving a fourth gear, said fourth gear driving said first rotating gear.

8. Method of claim 1 wherein at least one of said elongated arms is removable to facilitate removal of said one or more substrates from said arms.

* * * * *

UNITED STATES PATENT AND TRADEMARK OFFICE

CERTIFICATE OF CORRECTION

PATENT NO. : 7,498,062 B2
APPLICATION NO. : 10/853953
DATED : March 3, 2009
INVENTOR(S) : Anthony Calcaterra et al.

It is certified that error appears in the above-identified patent and that said Letters Patent is hereby corrected as shown below:

On the Title Page, line (73) Assignee:

Please delete "WD Media, Inc., San Jose, CA (US)" and replace therefore with -- WD Media, Inc., San Jose, CA (US); Knox Plastics, Inc., Santa Fe Springs, CA (US) --.

Signed and Sealed this

Third Day of August, 2010

David J. Kappos

David J. Kappos
*Director of the United States Patent and Trademark Office*